US005494250A

United States Patent [19]

Chen

[11] Patent Number: 5,494,250

[45] Date of Patent: Feb. 27, 1996

[54] CLEANING TISSUE HOLDER

[76] Inventor: Wen-Yen Chen, 9F-4, No.159, Sec.3. Si-Men Road, Tainan, Taiwan

[21] Appl. No.: 282,649

[22] Filed: Jul. 29, 1994

[51] Int. Cl.[6] ..... A47G 1/10

[52] U.S. Cl. ..... 248/316.7; 248/905

[58] Field of Search ..... 248/316.7, 905, 248/309.1, 316.1, 316.8, 316.4, 316.5, 316.3; 221/45, 46

[56] References Cited

U.S. PATENT DOCUMENTS

| | | | |
|---|---|---|---|
| 3,733,044 | 5/1973 | Rabner | 248/905 X |
| 4,176,817 | 12/1979 | Jones | 248/905 X |
| 5,145,139 | 9/1992 | Holtsch | 248/905 X |

*Primary Examiner*—Ramon O. Ramirez
*Attorney, Agent, or Firm*—Bacon & Thomas

[57] ABSTRACT

A cleaning tissue holder for hanging on a wall with nails passing through hanging holes, and having a clamping portion for receiving a pack of cleaning tissues, an upper fixing wall having a horizontal portion and a curved forward portion extending from the horizontal portion on the clamping portion, a bottom base at a bottom of the clamping portion, the bottom base having an elastic sloping-down push plate in an intermediate portion, a push plate being manually pushed down to let a pack of cleaning tissues move in the clamping portion, whereby releasing the push plate clamps the pack, with the top of the push plate firmly and elastically pushing up the bottom of the pack.

3 Claims, 4 Drawing Sheets

CLEANING TISSUE HOLDER

BACKGROUND OF THE INVENTION

This invention concerns a cleaning tissue holder, particularly directed to one having an elastic push plate for securing a pack of cleaning tissues in a clamping portion so as to let the cleaning tissues be easily pulled out of the pack for use.

So far, no known cleaning tissue holders have been seen or used, so in pulling out cleaning tissue from a pack, the pack is liable to move, thus making it inconvenient to use.

SUMMARY OF THE INVENTION

An object of the present invention is to offer a cleaning tissues holder for holding a pack of cleaning tissue so that the cleaning tissues in a pack may be easily pulled out for use.

A cleaning tissue holder in the present invention comprises a clamping portion for receiving a pack of cleaning tissue, and an elastic push plate with one or more projecting teeth to be pushed down manually to dispose a pack of cleaning tissues in the clamping portion, and releasing the push plate to let the plate move up to clamp the bottom of the pack securely in the clamping portion.

DETAILED DESCRIPTION OF THE INVENTION

Figure 1:
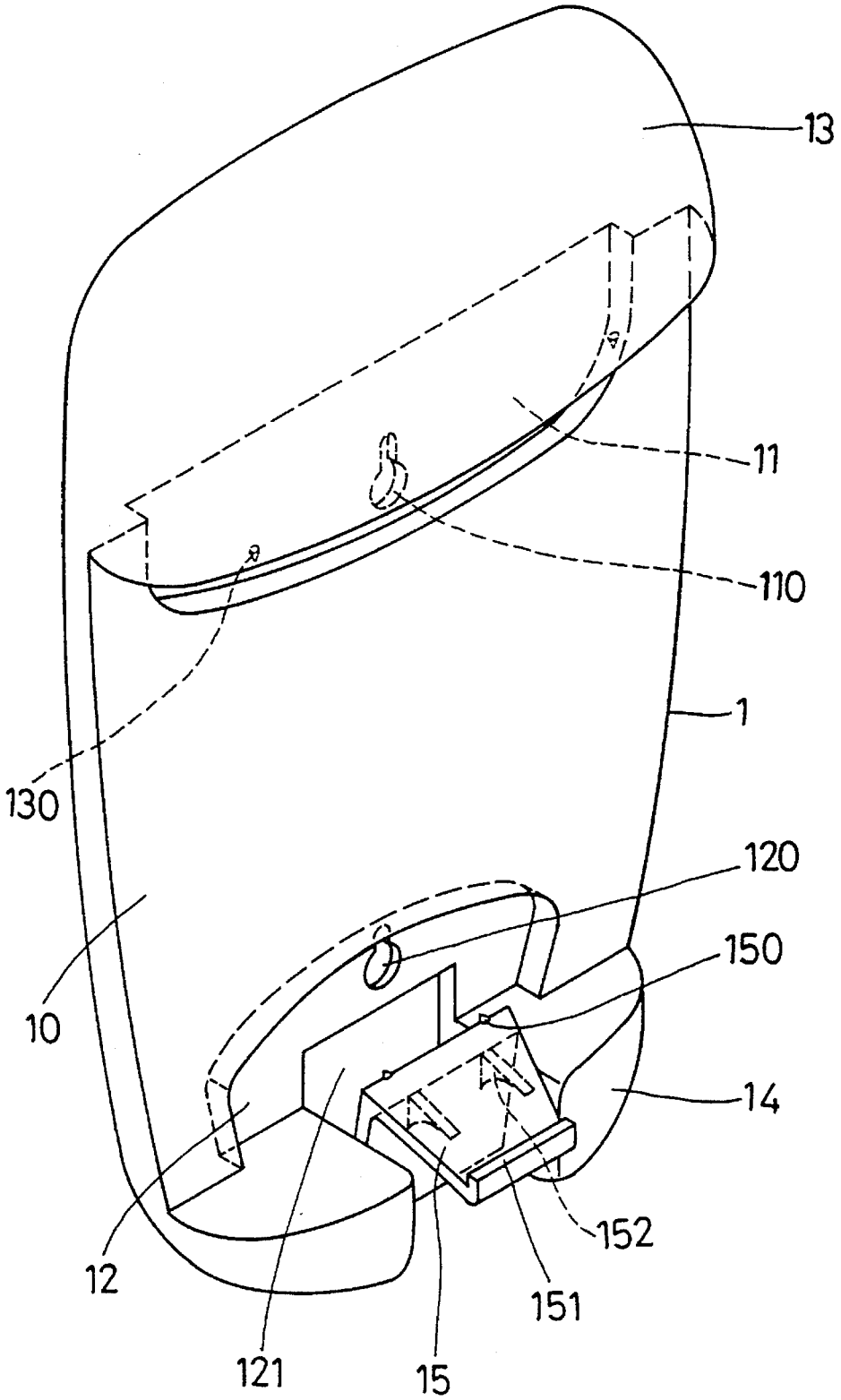
FIG. 1 is a perspective view of a cleaning tissue holder in the present invention.
Figure 2:
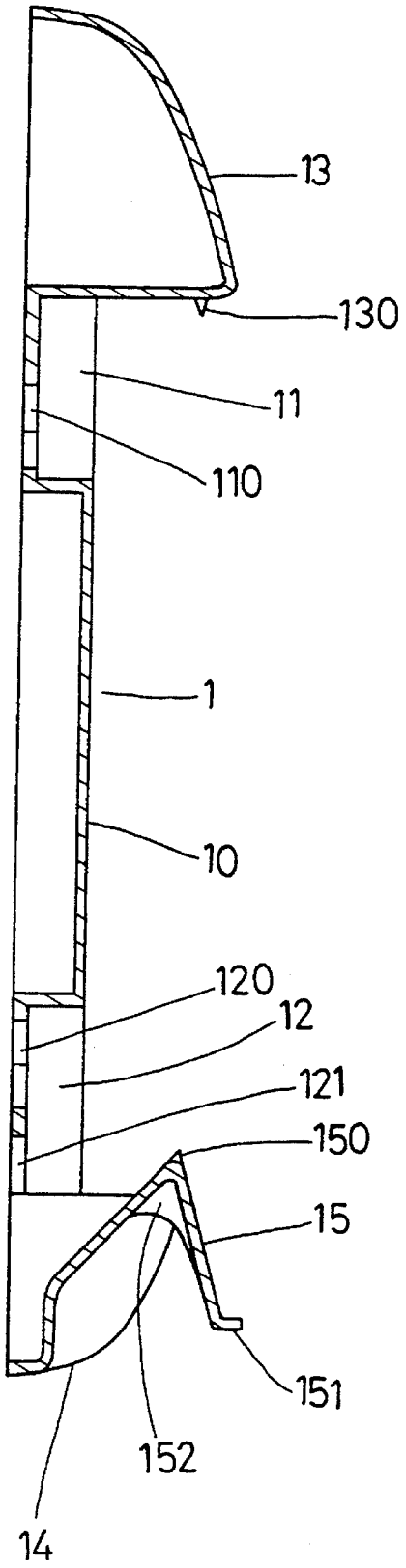
FIG. 2 is a side cross-sectional view of the cleaning tissue holder in the present invention.

A cleaning tissue holder 1 in the present invention, as shown in FIG. 1, is integrally made of a plastic material comprises a clamping portion 10, a fan-shaped recess 11, 12 respectively provided in an upper and a lower section of the clamping portion 10, a hanging hole 110, 120 respectively provided in the fan-shaped recesses 11, 12, with the recess 11 having a notch 121, an upper fixing wall 13 on the clamping portion 10, two spaced teeth 130, 130 under a horizontal portion of the fixing wall 13, a bottom base 14 under the bottom of the clamping portion 10, the bottom base 14 having an elastic push plate 15 sloping down in the intermediate portion of the base 14, two spaced clamping teeth 150, 150 on top of the push plate 15, a bent end portion 151 at the lower end, and two reinforcing ribs 152 on a rear surface, as shown in FIG. 2.

Figure 3:
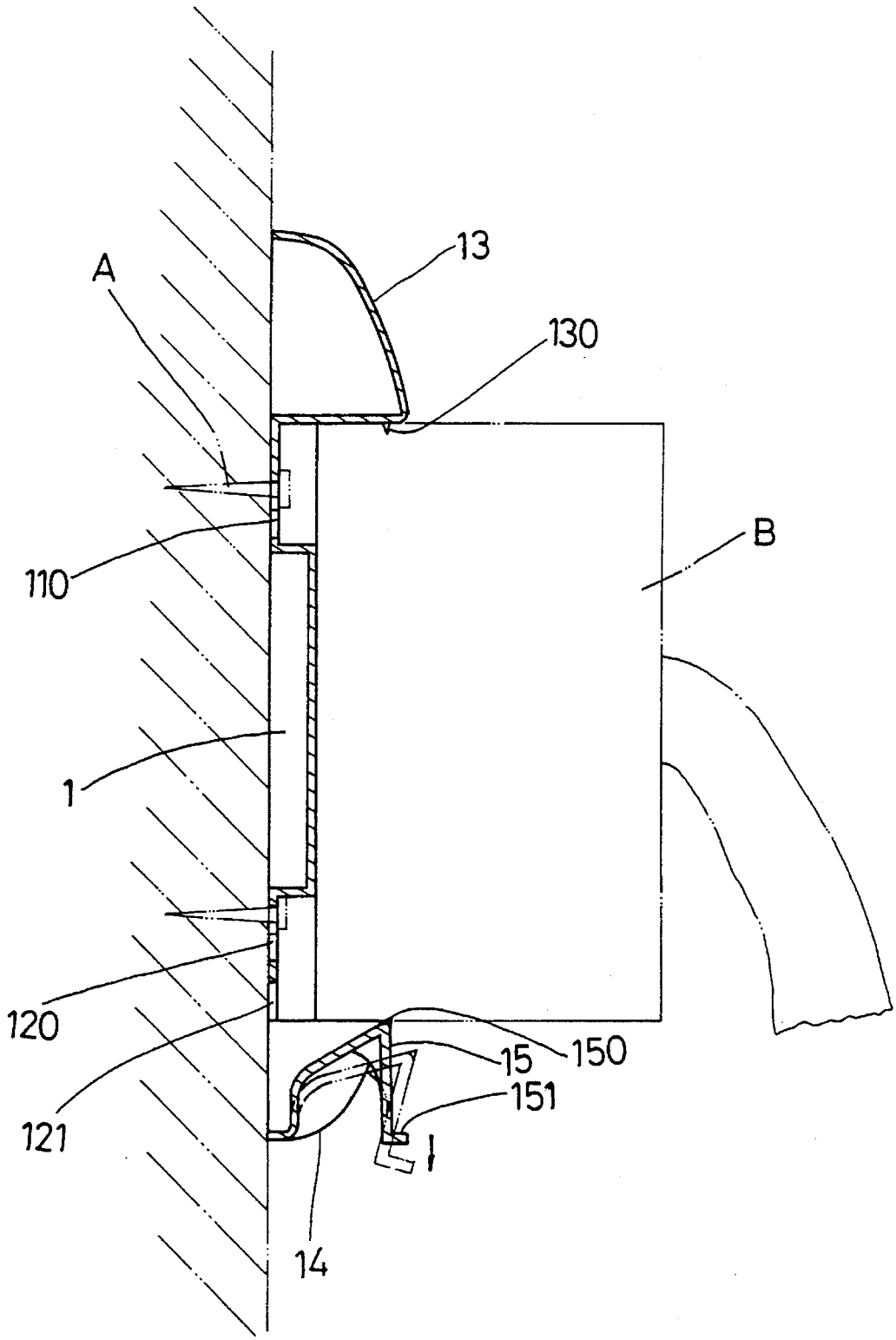
FIG. 3 is a side cross-sectional view of the cleaning tissue holder in the present invention, showing it holding a pack of cleaning tissues.

In using, as shown in FIG. 3, the cleaning tissue holder 1 is hung on a wall, with two nails A extending through the hanging holes 110, 120 and into the wall. Then a pack of cleaning tissues B is inserted into the clamping portion 10. The push plate 15 is then manually pushed down so that the clamping teeth 130 of the fixing wall 13 bites into the top of the pack of cleaning tissues B. The push plate 15 is then released, letting the clamping teeth 150 of the push plate 15 bite into the bottom of the tissue pack B. Thus, pack B is clamped stably between the fixing wall 13 and the bottom base 14, and cannot to slide to and fro, handy fro. This assembly is the cleaning tissues to be pulled out for use.

Figure 4:
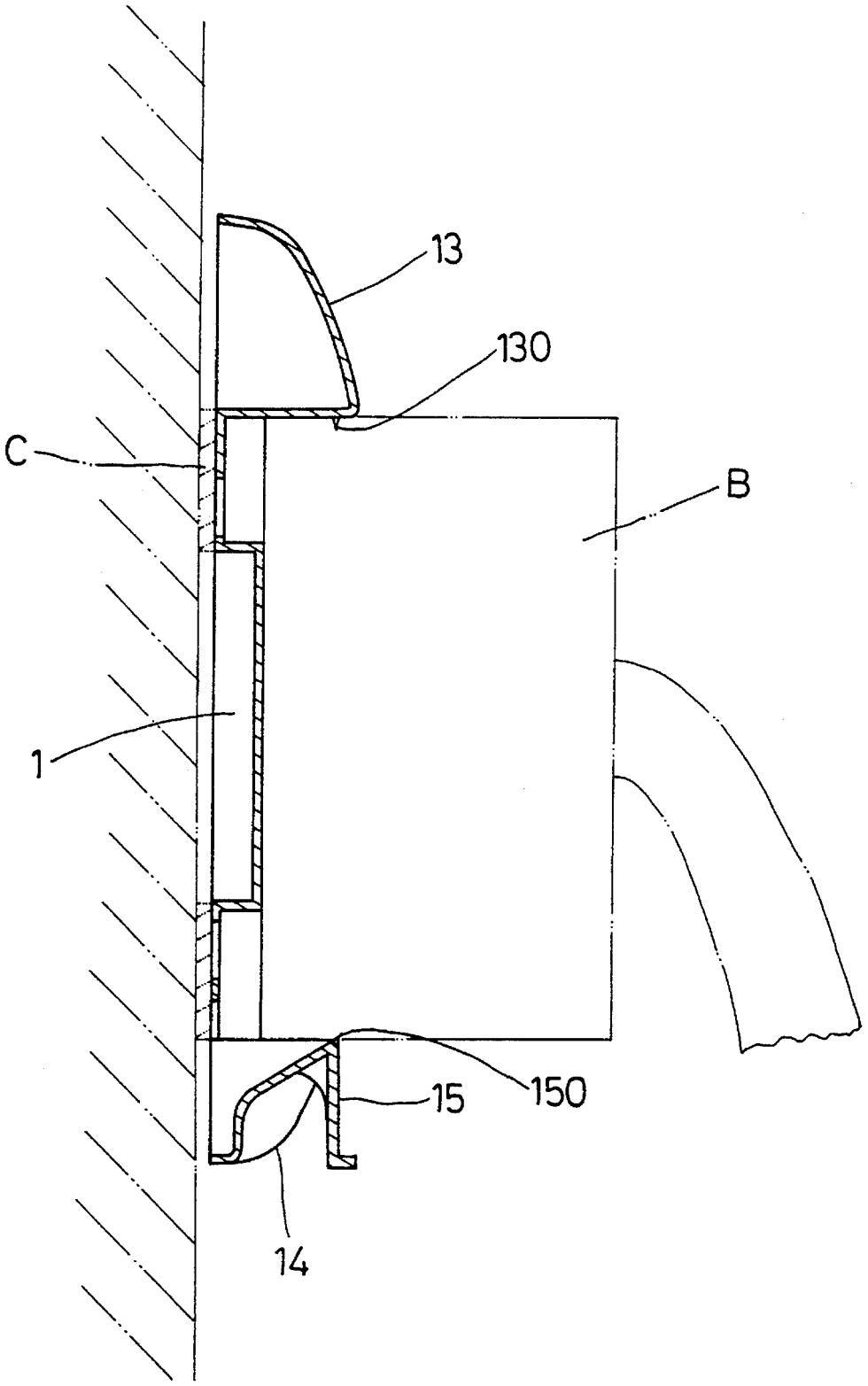
FIG. 4 is a side cross-sectional view of another embodiment of the cleaning tissue holder in the present invention.

Another embodiment of the cleaning tissue holder in the present invention, as shown in FIG. 4, has an adhesive sheet C with both adhesive surfaces glued on the rear surface of the cleaning tissue holder, allowing the holder 1 to be glued on a wall. This eliminates the use of nails A for hanging the holder on the wall.

As can be understood from the above description, this cleaning tissue holder has the following advantages.

1. It can hold a tissue pack securely and it is simple to displace the pack.

2. A tissue pack never slide to and fro when pulling out tissue, and the assembly is handy to use.

What is claimed is:

1. A cleaning tissue holder made of a plastic material and comprising:

a) a clamping portion including an upper section, a first recess in the upper section, a hole formed in the first recess for hanging the holder, and a bottom section;

b) an upper fixing wall above the clamping portion, the upper fixing wall including a horizontal bottom portion, a top portion, and curved front portion extending from the top portion to the horizontal bottom portion, and at least one clamping tooth projecting downwardly from the horizontal bottom portion; and c) a base at the bottom section, the base including a downwardly sloping elastic push plate having a top portion, at least one clamping tooth on the top portion, whereby the push plate may be pushed downwardly by a user to permit the insertion of a tissue pack in the clamping portion to be clamped therein upon release of the push plate.

2. The cleaning tissue holder of claim 1 wherein the bottom section includes a second recess and a hole formed in the second recess for hanging the holder.

3. The cleaning tissue holder of claim 1 wherein the clamping portion and upper fixing wall include an adhesive sheet for securing the holder on a wall.

* * * * *